US007144331B2

(12) United States Patent
Poynor

(10) Patent No.: US 7,144,331 B2
(45) **Date of Patent: *Dec. 5, 2006**

(54) METAL WOOD

(75) Inventor: Raymond L. Poynor, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 197 days.

This patent is subject to a terminal disclaimer.

(21) Appl. No.: 10/966,374

(22) Filed: Oct. 15, 2004

(65) Prior Publication Data

US 2006/0084523 A1 Apr. 20, 2006

(51) Int. Cl.
*A63B 53/02* (2006.01)
*A63B 53/04* (2006.01)

(52) U.S. Cl. ..... 473/305; 473/345; 473/349

(58) Field of Classification Search ..... 473/324, 473/325, 326, 342, 349, 350, 305, 345, 346
See application file for complete search history.

(56) References Cited

U.S. PATENT DOCUMENTS 4,432,549 A * 2/1984 Zebelean ..... 473/346
5,232,224 A * 8/1993 Zeider ..... 473/345
5,460,371 A 10/1995 Takeda ..... 273/80.2
5,485,998 A * 1/1996 Kobayashi ..... 473/345
5,575,723 A * 11/1996 Take et al. ..... 473/305
5,776,011 A 7/1998 Su et al. ..... 473/345
5,967,904 A 10/1999 Nagai et al. ..... 473/345
6,334,817 B1 1/2002 Ezawa et al. ..... 473/324
6,491,592 B1 * 12/2002 Cackett et al. ..... 473/342
6,669,576 B1 * 12/2003 Rice ..... 473/305
2002/0052247 A1 5/2002 Helmstetter et al. ..... 473/290
2002/0065147 A1 5/2002 Sano ..... 473/346
2003/0100381 A1 5/2003 Murphy et al. ..... 473/342

* cited by examiner

*Primary Examiner*—Sebastiano Passaniti
(74) *Attorney, Agent, or Firm*—D. Michael Burns

(57) ABSTRACT

A substantially hollow body metal wood golf club head has a wrap around insert that comprises a substantial portion of the front face. The insert having a wing-like extension that extends around the heel portion of the club head and a pre-determined distance of about 0.657 inch into the skirt portion of the club head. A gap of about 0.06 inch to about 0.36 inch is created between an internal thru-hosel and the interior wall of the heel. The gap represents material and weight that may be used more effectively in other parts of the club head. The lack of connection between the hosel and the front face creates a greater unsupported front face and therefore a greater "sweet spot" area.

17 Claims, 3 Drawing Sheets

METAL WOOD

FIELD OF THE INVENTION

The present invention relates generally to a metallic hollow golf club head, and specifically to the placement of a wrapped face insert having a wing element extending into the heel/skirt portion of the club body.

BACKGROUND OF THE INVENTION

Golf club "metal woods", were originally manufactured primarily by casting of durable metals such as stainless steel, aluminum, beryllium copper, etc. into a unitary structure comprising of a metal body, face and hosel. As technology progressed it became more desirable to strengthen the face of the club, and usually this was achieved by using titanium material.

With a high percentage of amateur golfers constantly searching for more distance on their drives, the golf industry has responded by providing golf clubs specifically designed with distance in mind. The head sizes have increased which allows for the club to possess a higher moment of inertia, which translates to a greater ability to resist twisting on off-center hits. However, as a wood head becomes larger, its center of gravity will be moved back away from the face resulting in hits flying higher than expected. Reducing the lofts of larger head clubs is one way to compensate for this. Also with the larger heads, the center of gravity is moved further away from the axis that is created by the intersection of the hosel with the sole plate. This can cause these large head clubs to remain open on contact, thereby inducing a "slice" effect (in the case of a right-handed golfer, the ball deviates to the right). Offsetting the head and incorporating a hook face angle can help compensate for this by "squaring" the face at impact, but often more is required to eliminate the "slice" tendency.

The technological breakthrough in recent years towards providing the average golfer with more distance, by increasing the club head size, has been to keep the weight constant or even lighter, by casting consistently thinner shell thickness and going to lighter materials such as titanium. Also, the club head faces have been steadily becoming extremely thin. These thinner faces will maximize what is known as the Coefficient of Restitution (COR), which means that the more the face rebounds upon impact, the more energy that may be imparted to the ball, thereby increasing distance. In order to make the faces thinner, manufacturers have moved to forged or stamped metal faces which are stronger, in most cases, than those that are cast. Common practice is to integrate the forged or stamped metal face by welding it to the body at the sole and crown transitions. These transitions are the points on the club head that absorb the greatest amount of stresses as the club strikes the ball.

A common feature of most metal wood designs that exhibit a thru-hosel construction is that there is an intimate connection between the face, hosel tube and heel portion of the skirt wall. This often results in a reduced unsupported face area due to a narrower supporting perimeter, thereby reducing the overall face flexibility and "sweet spot".

Therefore, it is very desirable to provide a method for attaching the impact face portion to the body of the club head without sacrificing any COR (Coefficient of Restitution) value or "sweet spot" size.

SUMMARY OF THE INVENTION

In accordance with one aspect of the invention, a metal wood golf club head is provided which includes a hollow body having a wrap around insert welded to the front face. The body is preferably cast as a single member and includes a sole portion, a crown portion, a front face, a toe portion that extends into the impact area of the front face portion, a heel portion, a skirt portion connecting the heel portion to the toe portion, a hosel portion comprising an internal thru-bore hosel tube, and an opening defined in the front face for receiving the wrap-around insert. The wrap around insert forms a substantial portion of the impact face of the club, and has at a distal end a wing section extending around and beyond the hosel tube and into the body at the heel/skirt area of the club. The distance the wing section extends into the skirt portion is at least 0.60 inch, and preferably about 0.657 inch.

In the invention a stamped plate is used for the wrap around insert, and since a stamped plate made of beta-titanium generally exhibits better strength and ductility properties than cast titanium, it is preferable to use it as a substantial portion of the impact face of the front section. It is appreciated that in the joining of the insert to the front face of the body, the welding is removed away from the crown/face and sole/face transition seams, which are points of critical stress. The present invention provides for these welds to be done a distance away from the transition seams, thereby keeping the thickness at the transitions much thinner than if welds were present. This increases the structural integrity of the club head and also achieves maximum allowable COR values.

In the invention, the wrap around design of the insert provides the ability to increase the club head volume behind the plane of the hosel, without having to add material and overall weight to maintain the connection between the hosel tube and adjacent skirt wall. The result of this is a larger unsupported face area and in addition to increasing the hitting area "sweet spot", it allows for more discretionary weight to be available to further optimize the mass properties of the club head, which is one of the key elements for achieving ideal launch conditions and overall performance.

The wrap around feature of the insert creates a gap of about 0.3 inch to about 0.625 inch between the hosel tube and the wall of the heel portion.

DETAILED DESCRIPTION OF THE PREFERRED EMBODIMENTS

Figure 1:
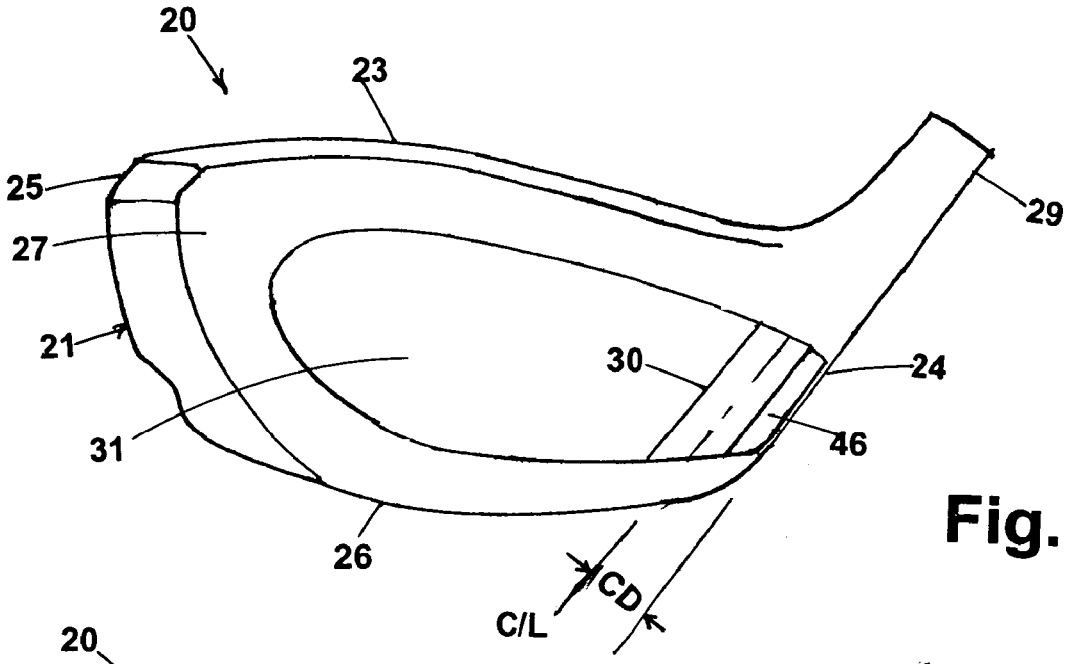
FIG. 1 is a front view of the club head body of the present invention showing the hosel tube and an opening in the body.
Figure 2:
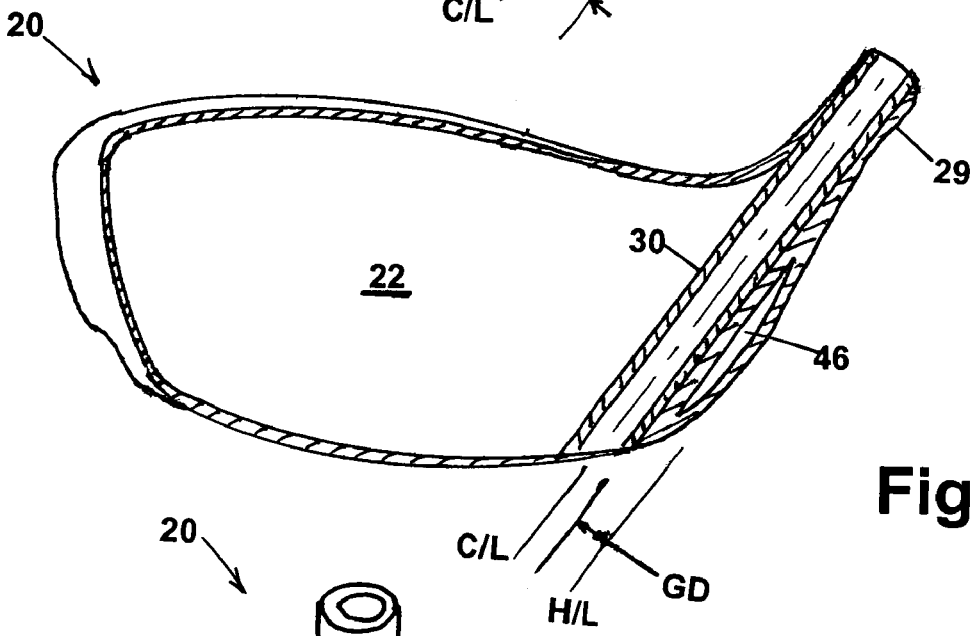
FIG. 2 is a front view of the thru-hosel design.
Figure 3:
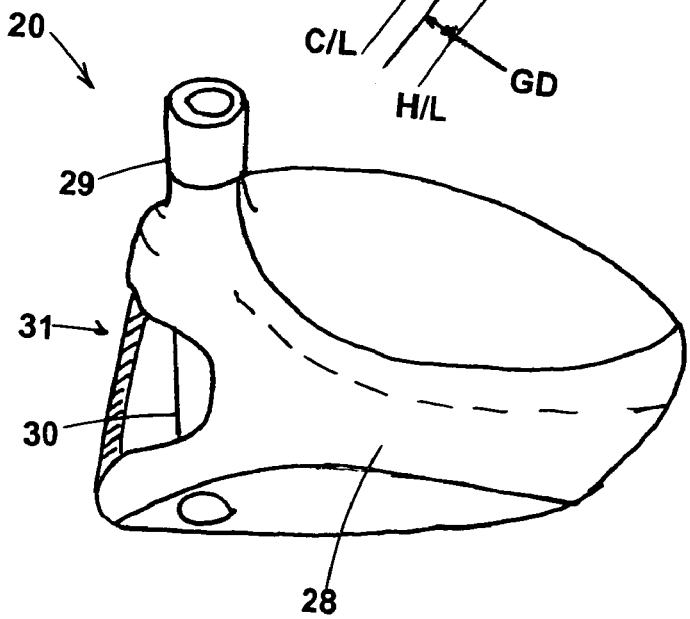
FIG. 3 is a heel elevation view showing the opening as it extends into the skirt section to accommodate the wrap around insert.
Figure 5:
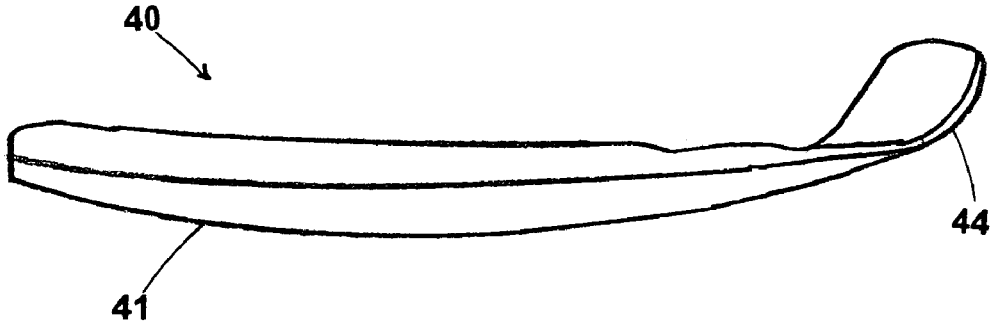
FIG. 5 is a top view of the insert of FIG. 4.
Figure 4:
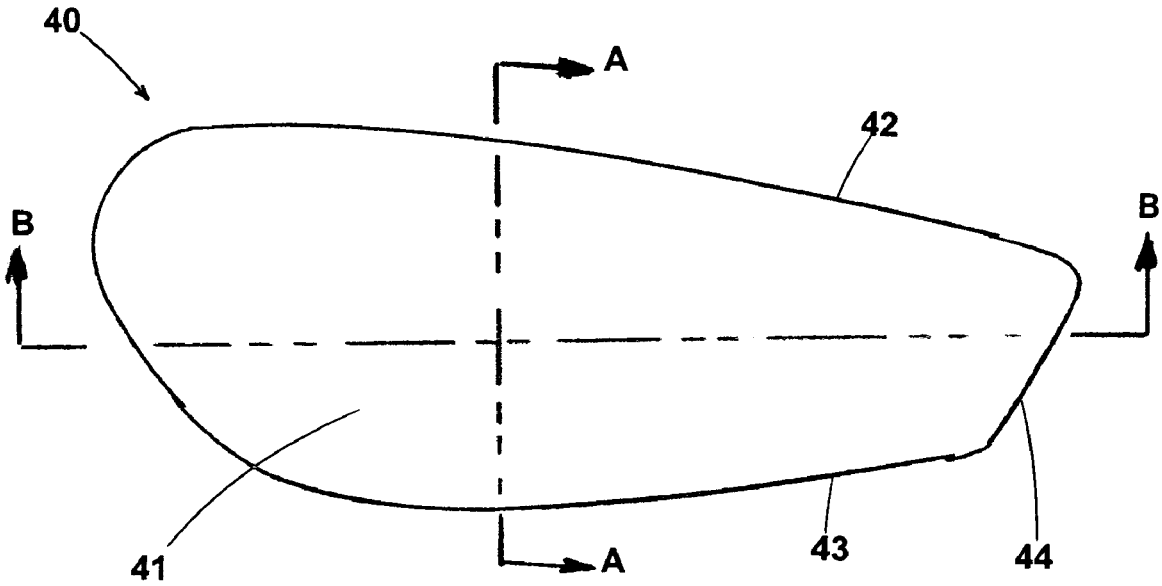
FIG. 4 is a front elevation view of the wrapped face insert.
Figure 6:
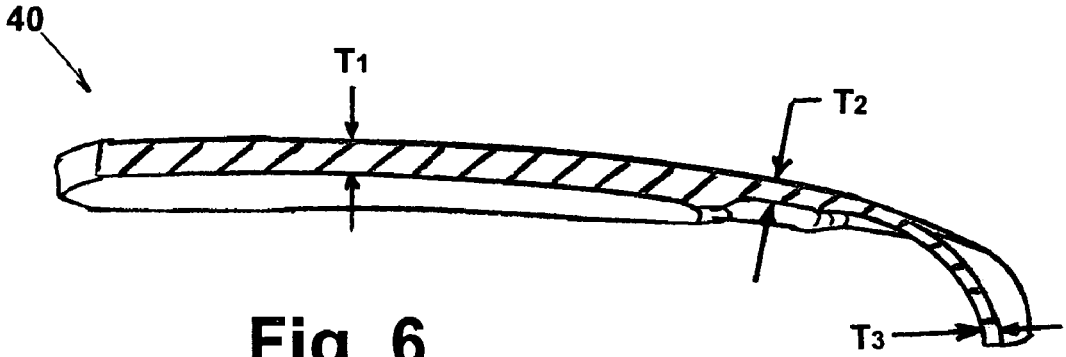
FIG. 6 is a partial cross section bottom view taken along line B—B of FIG. 4.
Figure 7:
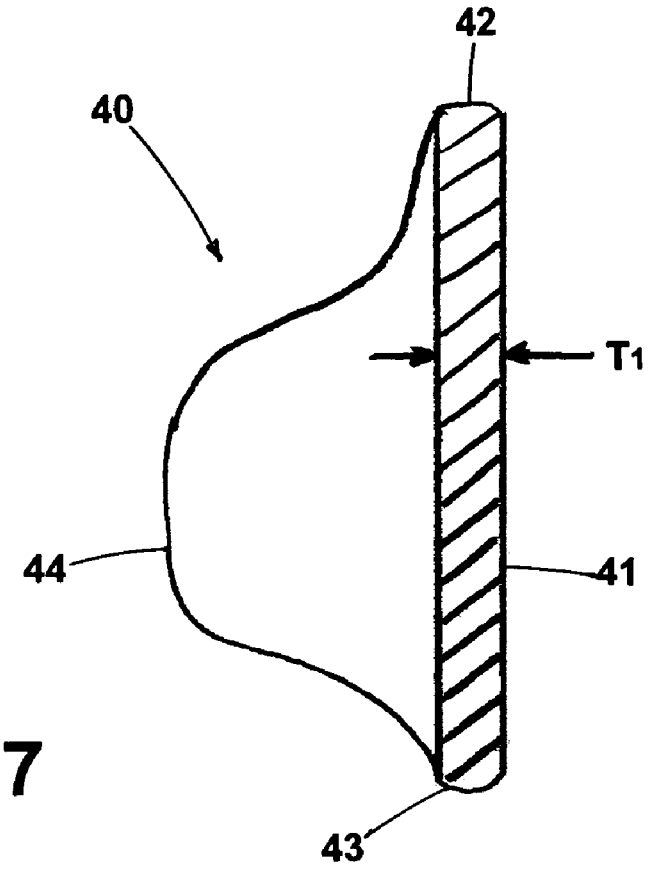
FIG. 7 is a partial cross sectional toe view along lines A—A of FIG. 4.
Figure 8:
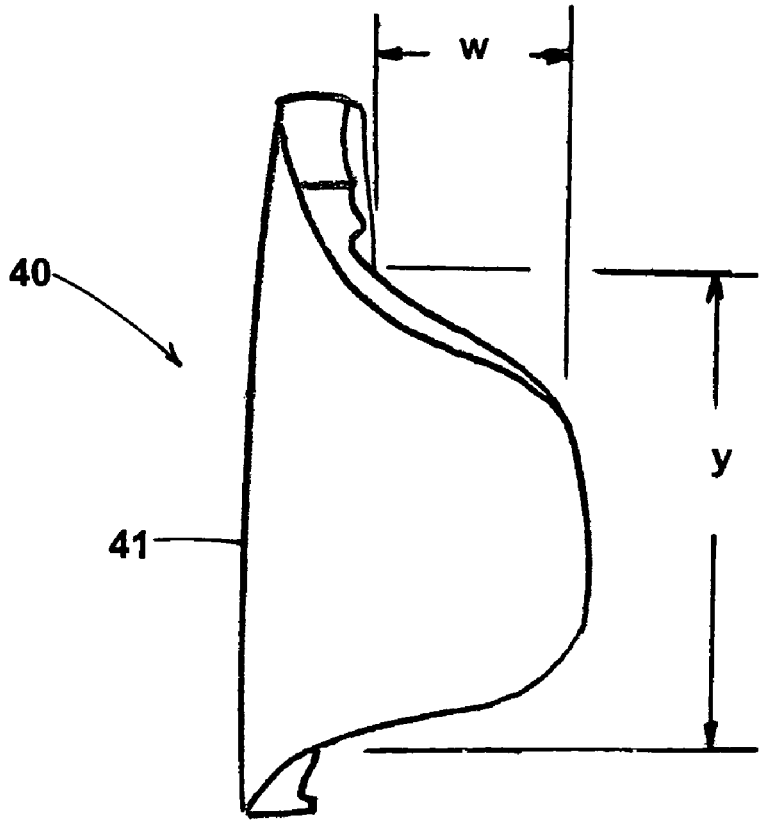
FIG. 8 is a heel view of FIG. 4.

Referring to the present invention, as shown in FIGS. 1–8, there is provided a golf club head 20, adapted for attachment to a golf club shaft, which for the sake of clarity, is not shown. Club head 20 is integrally formed by coupling the edges of a wrap-around metal insert 40, to a substantially hollow body 21 so as to form a cavity 22 therein. The preferred means for coupling is welding.

Body 21 is preferably cast of a titanium alloy. It may also comprise materials such as stainless steel, aluminum or composites. Body 21 includes a crown portion 23, a heel portion 24, a toe portion 25, a sole portion 26, a front face 27, a skirt portion 28 connecting the heel portion 24 to the toe portion 25, a hosel portion 29 comprising a hosel tube 30, and an opening 31 defined in the front face 27 of a size and shape for receiving the wrap around insert 40. The hosel tube 30 has a centerline C/L that intersects the sole portion 26, and the heel portion 24 has an outer surface line H/L.

As shown in FIGS. 4–8, the wrap around insert 40 includes an impact face 41, an upper edge 42, a lower edge 43, and a wing section 44 for extending outwardly into the skirt portion 28 and also below and beyond the hosel tube 30. Wing section 44 has a length y that is preferably greater than about 20 mm, and a width w that is preferably greater than 10 mm. Insert 40 is preferably made of stamped titanium plate, more preferably beta-titanium and may be of variable thickness.

The present invention, by incorporating the aforementioned wing section 44 into body 21, enables weight that is normally used in the hosel area, to be placed elsewhere in the club head 20 for optimum ball flight. The preferred size of the present invention club head is about 420 cc club head, and that size yield a savings of at least about 6 grams of material which can be then positioned at another location in the club head for improved performance.

The design of the cast body 21, in which the toe portion 25, crown portion 23 and sole portion 26 form part of the front face 27, is such that welding of these portions to the insert 40 is kept a relative distance away from the transition seams formed by those portions. This increases the stability of the cast body 21 during manufacture and also insures minimum deformation of the aesthetically critical toe portion 25 during welding or polishing. The welding engagement along the perimeter of the insert 40 shifts the weld zone away from the critical crown/face and sole/face transition seams, therein reducing the thickness at the seams; this is a vital parameter in maximizing COR value. Beta-titanium and Alpha-titanium materials are preferred in the impact face 41 of the insert 40 because of superior mechanical properties, such as strength and ductility.

Although the size of conventional face inserts varies from one design to another, one common feature that these constructions have is an intimate connection between the face, hosel tube, and heel portion of the skirt wall. This results in a reduced unsupported face area if a narrower supporting perimeter was utilized. This can also potentially reduce the overall face flexibility and sweet spot. The wrapped face insert 40 of the present design eliminates all interior connections with the front face portion 27, thereby maximizing the unsupported face area and allowing greater opportunity to increase the hitting area sweet spot. One notable improvement in the design of the wrap around insert 40 is the ability to increase the volume of the club head 20 behind the hosel plane, by eliminating material, and therefore overall weight, that has been necessary to maintain the connection between the hosel tube 30 and adjacent skirt wall 28. This results in a larger face area and more discretionary weight available to further optimize the mass properties of the club head 20, which is a key aspects towards achieving ideal launch conditional and overall performance.

As previously stated, the design of the wrap around insert 40 facilitates the removal of undesirable weight that is positioned between the internal hosel tube 30 and the skirt wall directly adjacent the hosel tube 30. Prior art cast body construction of any metal wood club head, when coupled with the thru-bore hosel design, usually requires a connection between the hosel tube and the adjacent skirt wall due to the complexity and manufacturability of a collapsible core that creates the hollow cavity. The present design utilizes the wrap around insert 41, which extends into and wraps around the heel portion of the face/skirt junction, thereby allowing access behind the hosel tube 30. This additional access behind the internal portion of the hosel tube 30 provides the clearance needed to increase the core volume to a point where is fully extends behind the hosel tube 30, yielding a hollow area where there once was unwanted material and added weight.

The wing section 44 extends into and engages the skirt portion 28 at a pre-determined distance. In a preferred embodiment, the predetermined distance x is at least 0.6 inch and preferably about 0.657 inch, as measured from the front center portion of the insert 40 to the edge 46 of the wing section 44. The insert 40 is attached to the body 21 generally by welding along an engagement line 45.

As described above, the wrapped face insert 40 may be preferably formed from a single stamped metal sheet plate, as shown in FIGS. 4–8, and may be of uniform thickness, but preferably is of a varied thickness with a wing section 44 formed by bending of the sheet metal. The thickness T1 at the central portion of the insert 40 is about 0.13 inch; and at the bending area the thickness T2 is about 0.08 inch, wherein it then tapers to a thickness T3 of about 0.06 inch, preferably about 0.057 inch, at the distal end of the wing section 44.

As stated above, the insert 40 attaches into the skirt junction of the body to create a gap 46 between the hosel tube 30 and the internal wall at the heel. The gap 46 is accessible only because the insert 40 wraps around the heel section of face and skirt junction. The distance CD between the hosel bore centerline C/L and the adjacent outer surface of the heel is in a range between about 0.3" to 0.625", and preferably about 0.388 inch for the present invention. The width GD of the gap 46 which is created between the hosel and the internal wall, is in a range between about 0.06" to about 0.36", and preferably about 0.125" for the present invention. Presently, the USGA rules App. 11 1d.ii indicates that the maximum distance allowable between the hosel bore centerline C/L and the adjacent outer surface of the heel is 0.625 inch.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head adapted for attachment to a shaft comprising:

a substantially hollow cast body and a wrap around insert;

the cast body comprising a crown portion, a sole portion, a toe portion, a heel portion, a skirt portion connecting the heel portion to the toe portion, a hosel portion including a hosel tube, a front face, and an opening defined in the front face for accepting the wrap around insert;

the hosel tube cast as a unitary part of the body at distance from an internal wall of the body; and the wrap around insert comprising at least a substantial portion of the front face, and a wing section extending outwardly, beneath, and around the heel portion to a predetermined distance into the skirt portion.

2. The club head according to claim 1, wherein the distance from a centerline of the hosel tube to an outer surface of the heel portion is about 0.3 inch to a maximum of 0.625 inch.

3. The club head according to claim 1, wherein an internal gap between the hosel tube and the internal wall of the body is about 0.388 inch.

4. The club head according to claim 1, wherein an internal gap between the hosel tube and the internal wall of the body is about 0.06 inch to about 0.36 inch.

5. The club head according to claim 1, wherein an internal gap between the hosel tube and the internal wall of the heel portion is about 0.125 inch.

6. The club head according to claim 1, wherein the wing section has a width greater than about 10 mm.

7. The club head according to claim 1, wherein the wing section has a length greater than about 20 mm.

8. The club head according to claim 1, wherein the wrap around insert is formed from a single stamped titanium plate.

9. The club head according to claim 1, wherein the cast body is titanium.

10. The club head according to claim 1, wherein the insert is made of stamped titanium plate.

11. The club head according to claim 10, wherein the insert is of uniform thickness.

12. The club head according to claim 1, wherein the insert is made of beta-titanium and is of variable thickness.

13. The club head according to claim 12, wherein the thickness at a central area of the insert is about 0.13 inch, at the bending area is about 0.08 inch, and at the distal end of the wing section is about 0.06 inch.

14. The club head according to claim 1, wherein the wing section extends a predetermined distance into the skirt portion of at least about 0.6 inch.

15. The club head according to claim 14, wherein the wing section extends a predetermined distance into the skirt portion of about 0.657 inch.

16. The club head according to claim 1, wherein the body comprises a volume range of about 350 to about 460 cc.

17. The club head according to claim 16, wherein the body comprises a volume of about 420 cc.

* * * * *